US006327721B1

(12) United States Patent
Devereaux et al.

(10) Patent No.: US 6,327,721 B1
(45) Date of Patent: Dec. 11, 2001

(54) TRANSPORTABLE HYDROTHERAPY EQUIPMENT

(76) Inventors: Thomas Devereaux; Sherry Devereaux, both of 1717 Fincher Rd., Canton, GA (US) 30114

( * ) Notice: Subject to any disclaimer, the term of this patent is extended or adjusted under 35 U.S.C. 154(b) by 0 days.

(21) Appl. No.: 09/444,069

(22) Filed: Nov. 22, 1999

Related U.S. Application Data

(60) Provisional application No. 60/163,454, filed on Nov. 4, 1999.

(51) Int. Cl.[7] ..... A61H 33/00; A61H 33/02; A47K 3/022; A47K 3/08

(52) U.S. Cl. ..... 4/541.3; 4/541.4; 4/574.1; 4/575.1; 4/579; 4/590; D23/280.2

(58) Field of Search ..... 4/590, 591, 584, 4/555, 556, 541.1, 541.3, 541.4, 541.5, 568, 573.1, 574.1, 575.1, 576.1, 577.1, 578.1, 579; D23/280.1, 280.2, 280.4, 277

(56) References Cited

U.S. PATENT DOCUMENTS

| | | | | |
|---|---|---|---|---|
| 2,589,592 | * | 3/1952 | Ocana | 4/590 X |
| 3,788,306 | * | 1/1974 | Eberhard | 4/541.3 X |
| 4,249,522 | * | 2/1981 | Carrier | 4/541.5 X |
| 4,346,485 | * | 8/1982 | Reed et al. | 4/555 |
| 4,546,506 | * | 10/1985 | Houle et al. | 4/555 |
| 4,796,312 | * | 1/1989 | Corlew | 4/555 |
| 5,343,576 | * | 9/1994 | Dannenberg et al. | 4/590 |
| 5,604,940 | * | 2/1997 | Shimizu | 4/541.1 |

FOREIGN PATENT DOCUMENTS

| | | | | |
|---|---|---|---|---|
| 2169196 | * | 7/1986 | (GB) | 4/541.4 |
| 300932 | * | 11/1993 | (JP) | 4/541.5 |

* cited by examiner

*Primary Examiner*—David J. Walczak
*Assistant Examiner*—Kathleen J. Prunner
(74) *Attorney, Agent, or Firm*—John L. James

(57) ABSTRACT

A hydrotherapy unit has a housing supporting a tub. The tub has sidewalls defining arm rests, end walls defining a foot rest and back rest, and a bottom defining a seat. The seat, arm rests, foot rest and back rest form a chair for the user. Jets are located strategically about the tub to circulate water to zone therapy areas of the body for hydrotherapy. The unit is mounted on wheels or skids for mobility.

1 Claim, 3 Drawing Sheets

TRANSPORTABLE HYDROTHERAPY EQUIPMENT

CROSS-REFERENCE TO RELATED APPLICATIONS

This application is a continuing application of provisional application Ser. No. 60/163,454 filed Nov. 4, 1999.

FIELD OF THE INVENTION

The present invention relates generally to a hydrotherapy equipment, and more particularly, to a whirlpool bath for circulating liquid to bathe a person and to treat body disorders and injuries.

BACKGROUND OF THE INVENTION

Hydrotherapy is used to treat a number of conditions that afflict the human body as well as for a relaxing massage. When partially submerged in a tub of water with a stream of water, air or mixture of the two impinging on submerged portions of the body, blood circulation is improved providing more oxygen for healing. Zone therapy reflex areas are believed to exist, especially on the hands and feet, that, when stimulated, increases blood flow to corresponding congested areas of the body. Circulating fluid in a hydrotherapy unit of conventional whirlpool bath can provide stimulation. Hydrotherapy units are not typically found in homes or apartments where people reside, and it is usually inconvenient to visit a commercial location. Home whirlpool baths are relatively expensive and are not standard equipment, particularly in apartment and older homes. Accordingly, it will be appreciated that it would be highly desirable to have a hydrotherapy unit that is relatively inexpensive and does not require a plumber to install. It is also desirable to have a hydrotherapy unit that is transportable so that apartment dwellers can use it where space is limited and can take it with them when they move.

SUMMARY OF THE INVENTION

The present invention is directed to overcoming one or more of the problems set forth above. Briefly summarized, according to one aspect of the present invention, a hydrotherapy unit comprises a housing and an elongated open tub mounted on the housing for holding a volume of fluid. The tub has a pair of upstanding sidewalls and end walls. Each sidewall has upper and lower portions horizontally offset from one another with a connecting bridging member forming an arm rest. One end wall has upper and lower portions horizontally offset from one another with a connecting bridging member forming a foot rest. The other end wall has upper and lower portions horizontally offset from one another with a connecting bridging member forming a back rest. The bottom of the tub has first and second portions vertically offset from one another with a connecting bridging member forming a seat. The tub thus has sidewalls defining arm rests, end walls defining a foot rest and back rest, and a bottom defining a seat. The seat, arm rests, foot rest and back rest form a chair for the user. Jets are located strategically about the tub to circulate fluid about particular portions of the body of a person seated in the tub. The unit is mounted on wheels for transportability. An electrical power cord connects the unit to a power source to power the pumps and jets, while hoses provide water for filling and draining the tub.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
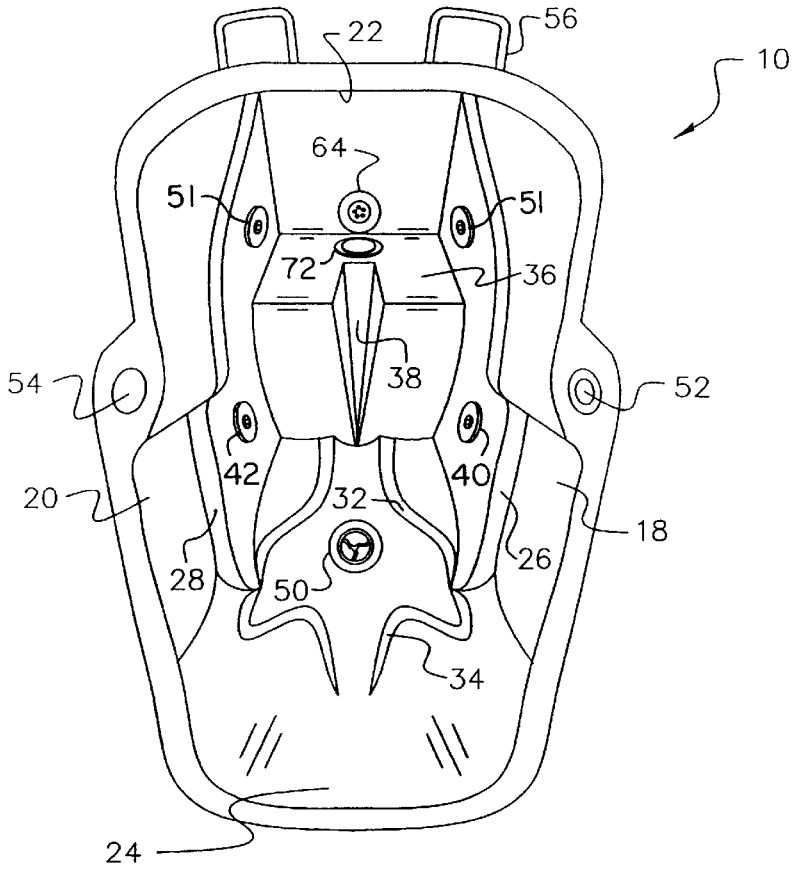
FIG. 1 is a top perspective view, of a preferred embodiment of a hydrotherapy unit having a chair formed in the tub according to the present invention.
Figure 3:
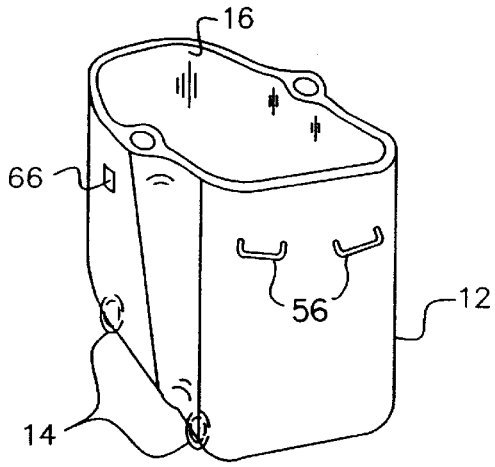
FIG. 3 is a perspective view of the hydrotherapy unit of FIG. 1 illustrating the handle.
Figure 2:
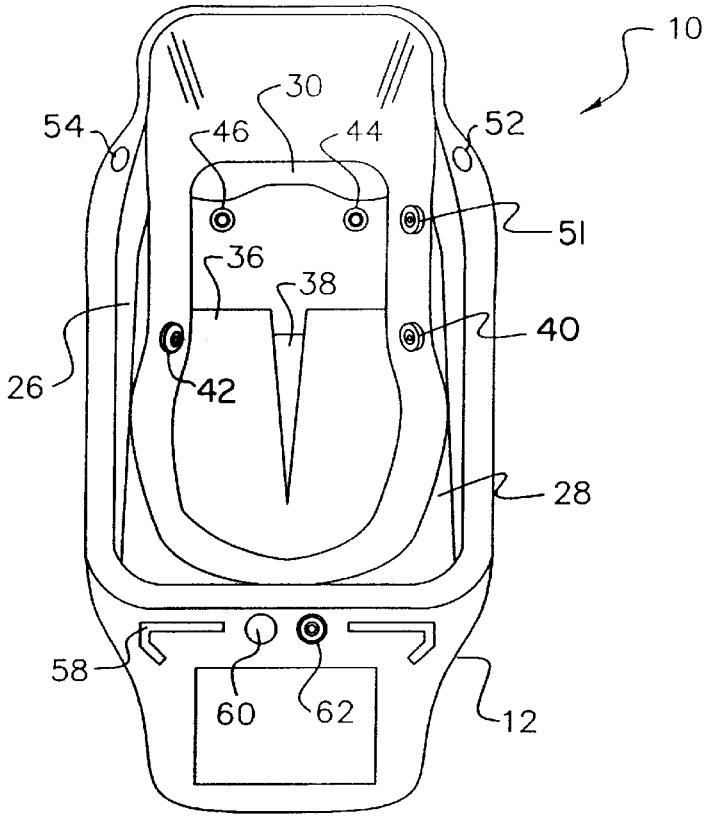
FIG. 2 is a top perspective view, looking from the head toward the foot, of the hydrotherapy unit of FIG. 1.
Figure 6:
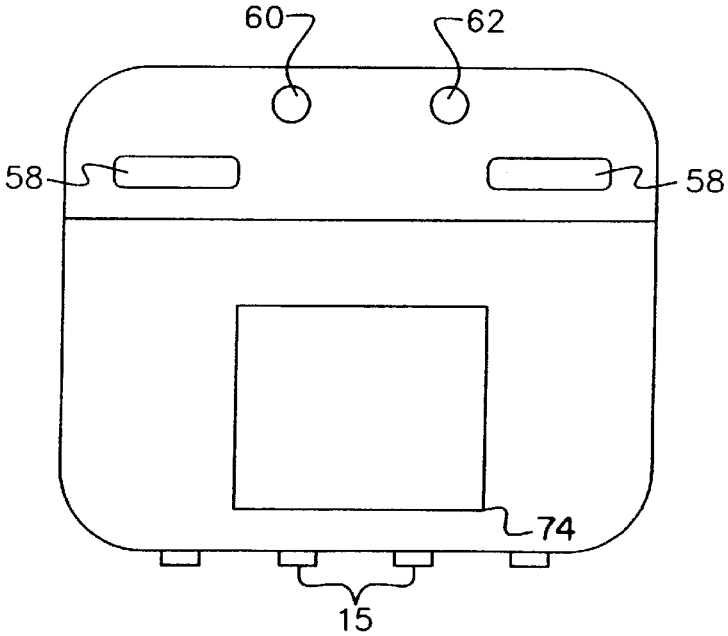
FIG. 6 is a head end view of a hydrotherapy unit with the access door closed.

Referring to FIGS. 1–3, a transportable hydrotherapy unit 10 has a housing 12 that is mounted on wheels 14 so that the hydrotherapy unit 10 can be rolled about. Wheels 14 are mounted inside housing 12 to provide an aesthetic appearance and to facilitate moving the hydrotherapy unit through a doorway or from one room to another. Wheels 14 are preferably pressure locking to keep the unit stationary during use. Such wheels are spring loaded and factory set to lock at a predetermined load. For increased aesthetic appeal only a small portion of each wheel is visible below the bottom of the housing, but is sufficient for maneuverability on carpeted floors. Alternatively, a plurality of ribs or skids 15 can be used (FIG. 6).

The hydrotherapy unit 10 includes an elongated open tub 16 mounted on housing 12 for holding a volume of fluid, such as water or water containing therapeutic and relaxation substances. Typical substances include essential oils, flower essences, oatmeal, minerals, Epsom salt, hydrogen peroxide, baking soda and milk, as well as prescription medications. Housing 12 and tub 16 are preferably constructed of a reinforced resinous material such as the fiberglass reinforced plastic materials commonly used for bathtubs and showers, or a thermoset plastic material. The contours of the tub are void of sharp corners to be aesthetically pleasing, to facilitate fluid flow and to be more comfortable.

Housing 12 and tub 16 may be separately molded or fabricated and assembled together. When assembled, the housing forms the exterior sidewalls of the unit while the tub forms the inner sidewalls of the unit with space between the exterior sidewalls and inner sidewalls to accommodate tubing, wiring and equipment needed for the unit.

Elongated tub 16 has a pair of upstanding sidewalls 18, 20 and a pair of upstanding end walls 22, 24. The first sidewall 18 of the pair of sidewalls is on the right side of the tub and has upper and lower portions that are horizontally offset from one another with a bridging member 26 connecting the upper and lower portions forming a right arm rest. The right arm rest slants downward like the arm of an easy chair to make the arm rest more comfortable for a user sitting in the tub whose arm would be more comfortable slanted downward from the elbow rather than slanted upward. Similarly, the second sidewall 20 of the pair of sidewalls is on the left side of the tub and has upper and lower portions that are horizontally offset from one another with a bridging member 28 connecting the upper and lower portions forming a left arm rest. The left arm rest also slants downward.

Figure 4:
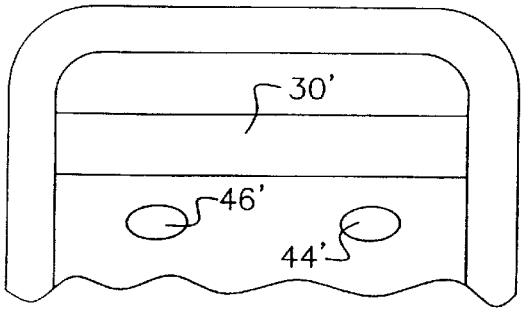
FIG. 4 is a diagrammatic view of another embodiment of a foot rest with a single platform and dual jets.
Figure 5:
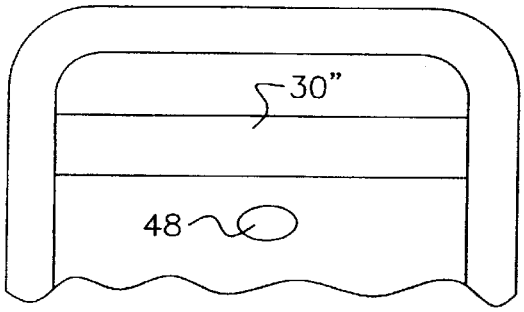
FIG. 5 is a diagrammatic view similar to FIG. 4 but illustrating another embodiment of a foot rest with a single platform and a single jet.

The first end wall 22 is at the foot of the tub and has upper and lower portions that are horizontally offset from one another with a bridging member 30 connecting the upper and lower portions forming a foot rest. Preferably, bridging member 30 is bifurcated having a general"U" configuration to provide a resting place for the feet of a user with a left foot on one leg of the"U" and a right foot on the other leg of the "U". Alternatively, the foot rest may be formed of a simple bridging member 30' that is generally rectangular in configuration with rounded or curved corners fitting the contour of the tub and dual jets 44', 46' (FIG. 4); or, may be formed of a simple bridging member 30" that is generally rectangular in configuration with rounded or curved corners fitting the contour of the tub and a single jet 48 (FIG. 5).

The second end wall 24 is located at the head of the tub and has upper and lower portions that are horizontally offset from one another with a bridging member 32 connecting the upper and lower portions forming a back rest. The lower portion of the back of a user contacts the back rest when seated during use of the tub. A vertically extending groove 34 extends the length of the back rest and maybe wider at its top than at its bottom. Preferably, the top of the groove 34 is divided into multiple groove segments with one groove segment adjacent the left arm rest and another groove segment adjacent the right arm rest.

The bottom of the tub has first and second portions vertically offset from one another with a bridging member 36 connecting the first and second portions forming a seat. The first portion of the tub bottom is connected to the lower portion of the end wall 22 at the foot of the tub, and the second portion of the tub bottom is connected to the lower portion of the other end wall 24 at the head of the tub. By this construction, a chair is formed that has a seat formed by bridging member 36, a right arm rest formed by bridging member 26, a left arm rest form by bridging member 28, a foot rest formed by bridging member 30, and a back rest formed by bridging member 32. The upper portion of the second end wall 24 at the head of the tub is offset from the back rest thereby forming a head rest.

A person using the tub may sit in the seat with his arms supported by the arm rests, his feet supported by the foot rest, and his head elevated and tilted back slightly against the head rest for a comfortable sitting position. A horizontal groove 38 extends from the back rest groove 34 toward the first end wall 22 at the foot of the tub. The arm rests slant downward because they have a higher elevation near the seat than near the foot rest for the comfort of the user. The foot rest is bifurcated to provide a resting platform for each foot. The back rest groove 34 and seat groove 38 provide conduits for the circulation of the fluid about the user in the tub.

The unit may be used for regular bathing or for therapeutic massage or for cleaning the body, such as when there is dead skin or debris to be removed for example. The various functions of the unit are accomplished by using a number of jets which may circulate air or liquid to cause the fluid in the tub to impact the body of the user, particularly at specific zone therapy regions of the body. Openings for the jets are provided in the tub. A jet 40 is located in the right sidewall 18 below the right arm rest above the seat to circulate fluid to the upper right torso of a person seated in the tub. Similarly, a jet 42 is located in the left sidewall 20 below the left arm rest above the seat to circulate fluid to the upper left torso of a person seated in the tub. A jet 44 exists in the first end wall 22 below the right foot platforms to circulate fluid about right foot and ankle of a person seated in the tub, and a second jet 46 exists in the first end wall below the left platform to circulate fluid about the left foot and ankle. Alternatively, a single jet 48 or dual 44', 46' may exist in the first end wall below the foot rest to circulate fluid about the feet and ankles of a person seated in the tub. Another jet 50 exists in the second end wall 24 above vertical groove 34 to circulate fluid about the back of a user and also the buttocks and thighs via grooves 34, 38. Additional jets 51 in the sidewalls target the legs and thighs.

An air switch 52 is positioned in an opening in the right top edge of the tub, and an air inlet 54 is positioned in the left top edge of the tub to facilitate making bubbles in the fluid when the air switch 52 is operated. For left handed persons, the air switch could be located in the left top edge of the tub and the air inlet could be located in the right top edge of the tub.

Figure 7:
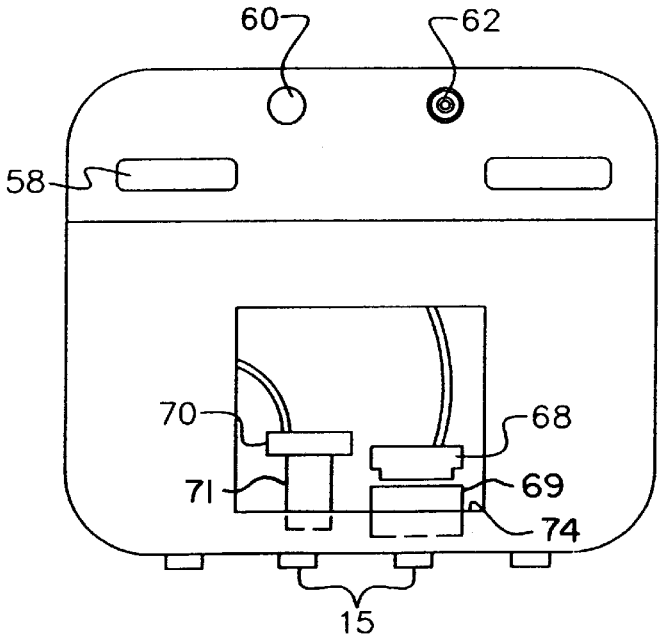
FIG. 7 is a head end view of a hydrotherapy unit with the access door removed.

Referring to FIGS. 1, 6 and 7, a handle 56 is attached to the exterior of the housing at the foot of the unit to facilitate transporting the unit and moving the unit about. The handle may be a single hand hold or may be dual hand holds, one for each hand. On the other end of the tub, a bracket 58 is attached for storing hoses and electrical power cords. Positioned above the bracket 58 are air pump switch 60 and a combination overflow and drain 62. The combination overflow and drain 62 is preferably connected through tubes to a tub drain 64. When the tub is drained, fluid exits the tub through drain 64 and is pumped through a discharge tube to exit through combination overflow and drain 62. During normal use, as the fluid level in the tub rises, the fluid level also rises in the discharge tube. When fluid in the discharge tube reaches a predetermined threshold level, it activates a switch causing fluid to be evacuated until the level drops below the threshold level. Alternatively, the overflow and drain 62 may simply allow fluid to escape when the fluid level in the tub exceeds a threshold level without activating the discharge pump.

Electrical power is received from an electrical power cord plugged into a standard wall outlet by a ground fault circuit interrupter 66 mounted on the housing. The face of the ground fault circuit interrupter 66 is flush or nearly flush with the exterior wall of the housing. A special power cord with two male ends is preferred to encourage using the power cord only with the hydrotherapy unit. The unit can be used with any household current source by simply plugging it in without regard to whether the current source has ground fault protection.

Referring to FIG. 7, a drain pump 68 mounted on the interior of the housing 12 receives power from circuit interrupter 66. Pump 68 is connected to the discharge tube to pump fluid from the tub when the air pump switch 60 is activated. Drain pump 68 also operates in response to the fluid level in the discharge tube reaching the threshold level to prevent the tub from overflowing.

A second pump 70 is used to pump fluid through jets in the jet openings. Pump 70 is operated by air switch 52 and air flow into the tubing to create air bubbles in the fluid is controlled by a manually operated valve in air inlet 54. Fluid from the tub enters the tubing to combine with the air through fluid outlet 72 located in bridging member 36 below groove 38. Pumps 68 and 70 are electrically powered and are elevated in the housing, on wooden blocks 69, 71 or the like, to be above the bottom of access door 74. Elevation of the pumps isolates the electrical components from water which may be present in the bottom of the housing from time to time due to tub leaks, a flooded room or careless handling of the fill hose.

Operation of the hydrotherapy unit is believed to be apparent from the foregoing description and drawings, but a few words will be added for emphasis. The unit is rolled on its wheels or slid on its skids to the desired location and the tub filled with water by attaching a fill hose to a water faucet to fill to the desired level. Filling the tub will cause wheels to lock when water in the tub reaches a predetermined level to immobilize the unit. The drain hose is preferably attached prior to filling or during filling and routed to a suitable household drain. An invalid can be lowered onto the seat prior to attaching the power cord. A person not needing assistance will attach the power cord prior to entering the tub. Additives to the water cam be introduced as the tub fills or at any time according to instructions for the additive. The jets for circulating the fluid are turned on by pressing the air switch near the right hand of the user. Fluid turbulence is controlled by adjusting the air intake near the left hand of the user.

During use, if the fluid rises above the predetermined threshold level, the drain pump automatically operates to pump out excess fluid. While in use, the jets direct fluid to trigger points on the body of the user. The recessed lower back jet targets the lower back while thigh jets target the thighs and benefit the colon. The foot jets provide foot zone therapy which benefits most parts of the body. While seated, the angle of the seat helps eliminate pressure on the hips and lower back. For relaxation, the optimum angle between the seat and backrest is about sixty degrees.

When finished with the bath or therapy, the discharge pump switch is operated to drain the tub. The power cord and hoses are coiled about the bracket until the next use. The wheels or skids are used to move the unit to its storage area until needed.

It can now be appreciated that a transportable hydrotherapy unit has been presented that features a chair with strategically positioned jets. It can be used by athletes, arthritic patients, accident victims and handicapped persons for physical therapy, by burn victims for skin cleansing and oxygenation, and by anyone desiring a relaxing massage. It can be used in hospitals, nursing facilities, schools and other institutions, and homes as well. The unit features a nonskid seat, nonskid foot rests, built-in ground fault protection, air switches and an automatic over flow. Its wheels or skids allow for easy movement from a storage location to a work location. For carpeted areas, skids are generally superior to wheels. Its unique design allows a person to sit comfortably in the chair with the body submerged to the shoulders or neck.

Because the unit is constructed of waterproof material with the working components protected from the elements, it can be used outdoors as well as indoors. An adult version of the unit weighs about 145 pounds and can be filled in about fifteen minutes or drained in fifteen minutes or less. From the wheels to the top of the back rest an adult unit stands at 36 inches with an inside dimension from top of head rest to top of seat of about 33 inches. At the air switch and air inlet the unit measures about 28 inches narrowing to about 26½inches at the head and about 23 inches at the foot. At the foot the tub is about 29 inches deep. The seat is raised about 9½ inches off the floor and is about 19 inches from front to rear. The arm rests are about 13½ inches from the rear of the seat which curves a bit for comfort. Draining of the seat is aided by the seat groove. These dimensions allow the body to be submerged while using no more water than a standard bath tub.

While the invention has been described with reference to the hydrotherapy unit, it is apparent that the invention is easily adapted to other uses, such as bath tub for dwellings equipped with only a shower or an additional bath tub where needed. It can function as an auxiliary bath tub in dwelling units equipped with a garden tub which can be one of a variety of configurations, many of which are not really adapted to a comfortable, relaxing bath. The present invention enables a person to sit in an upright position which is conducive to reading, watching television, listening to music or manicuring nails while bathing.

While the invention has been described with particular reference to the preferred embodiments, it will be understood by those skilled in the art that various changes may be made and equivalents may be substituted for elements of the preferred embodiment without departing from the invention. For example, the unit housing may be finished with a texture or covered with fabric or thermoset material to compliment a particular decor, and the tub may be virtually any color desirable.

In addition, many modifications may be made to adapt a particular situation and material to a teaching of the invention without departing from the essential teachings of the present invention. For example, while the standard adult unit accommodates a person at least 60 inches tall, it can be scaled for shorter persons. For wide persons, the unit can also be enlarged, but may not fit through a standard door that is 30 inches wide. With a wider door opening, the unit is still easily moved from one room to another.

As is evident from the foregoing description, certain aspects of the invention are not limited to the particular details of the examples illustrated, and it is therefore contemplated that other modifications and applications will occur to those skilled in the art. For instance, the power cord and circuit interrupter can be made mateable with one another and not mateable with any standard or available device to thereby discourage use of other power cords and discourage using the unit's power cord with another device. It is accordingly intended that the claims shall cover all such modifications and applications as do not depart from the true spirit and scope of the invention.

What is claimed is:

1. A hydrotherapy apparatus, comprising:

a housing;

an elongated tub open mounted on said housing for holding a volume of fluid, said tub defining a seat and having a pair of upstanding sidewalls, a bottom and a pair of upstanding end walls;

a first sidewall of said pair of sidewalls defining a first arm rest;

a first sidewall jet in said first sidewall below said first arm rest and above said seat;

a second sidewall of said pair of sidewalls defining a second arm rest;

a second sidewall jet in said second sidewall below said second arm rest and above said seat, said sidewall jets circulating fluid about the upper torso of a person seated in the tub;

a first end wall of said pair of end walls defining a foot rest;

at least one foot jet in said first end wall below said foot rest for directing fluid toward the feet of the person seated in the tub;

a second end wall of said pair of end walls defining a back rest with a centrally disposed vertically extending groove;

said bottom of said tub defining the seat having a centrally disposed horizontal groove, said vertical groove in said back rest and said horizontal groove in said seat intersecting one another;

a jet in said second end wall above said vertical groove of said back;

a jet pump mounted in said housing for injecting fluid into said tub through said jets;

first means for controlling operation of said jet pump;

a drain positioned in said housing for evacuating fluid from said tub;

a drain pump mounted in said housing and connected to said drain to speed evacuation of fluid from said tub;

second means for controlling operation of said drain pump; and third means attached to said housing for facilitating transport of said hydrotherapy apparatus from one room to another.

* * * * *